US006250592B1

(12) United States Patent
Davis

(10) Patent No.: US 6,250,592 B1
(45) Date of Patent: Jun. 26, 2001

(54) ADJUSTABLE BOTTLE HOLDING APPARATUS

(76) Inventor: Emma A. Davis, 203 E. 2nd St., Seaford, DE (US) 19973

( * ) Notice: Subject to any disclaimer, the term of this patent is extended or adjusted under 35 U.S.C. 154(b) by 0 days.

(21) Appl. No.: 09/488,991

(22) Filed: Jan. 21, 2000

(51) Int. Cl.[7] ..... A47D 15/00
(52) U.S. Cl. ..... 248/104; 248/102
(58) Field of Search ..... 248/104, 103, 248/102, 105, 106, 160, 311.3, 276, 74.1, 74.2, 74.3; 24/339, 510

(56) References Cited

U.S. PATENT DOCUMENTS

| | | | | |
|---|---|---|---|---|
| D. 369,413 | | 4/1996 | Lodewyck, Jr. et al. | D24/199 |
| 1,509,940 | * | 9/1924 | Elliott | 248/102 |
| 2,183,332 | * | 12/1939 | Haritos | 248/104 |
| 3,398,919 | * | 8/1968 | Tokar | 248/103 |
| 4,114,847 | | 9/1978 | Bogensberger | 248/104 |
| 4,989,811 | | 2/1991 | Millis et al. | 248/104 |
| 5,016,845 | * | 5/1991 | Pellegrino | 248/104 |
| 5,135,189 | | 8/1992 | Ghazizadeh | 248/104 |
| 5,192,041 | * | 3/1993 | Bryant | 248/104 |
| 5,489,075 | | 2/1996 | Ible | 248/104 |
| 5,603,479 | | 2/1997 | Kristy | 248/548 |
| 5,704,505 | | 1/1998 | Singh | 215/397 |

* cited by examiner

*Primary Examiner*—Leslie A. Braun
*Assistant Examiner*—Gwendolyn Baxter

(57) ABSTRACT

A adjustable bottle holding apparatus for allowing a parent to perform other activities while a baby is being fed. The adjustable bottle holding apparatus includes a flexible elongate tubular member having a first end and a second end; and also includes a clamping member securely attached to the first end of the flexible elongate tubular member with the clamping member having a first clamping portion hingedly attached to a second clamping portion for clamping about an object such as a frame of a crib; and further includes a first arcuate member hingedly attached to a second arcuate member and being lockingly fastened about a bottle with a ring member being fitted about a bottle and with the first and second arcuate members being lockingly fastened about the ring member.

14 Claims, 2 Drawing Sheets

ADJUSTABLE BOTTLE HOLDING APPARATUS

BACKGROUND OF THE INVENTION

1. Field of the Invention

The present invention relates to an extra hand adjustable bottle holder feeder and more particularly pertains to a new adjustable bottle holding apparatus for allowing a parent to perform other activities while a baby is being fed.

2. Description of the Prior Art

The use of extra hand adjustable bottle holder feeder is known in the prior art. More specifically, extra hand adjustable bottle holder feeder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,603,479; 5,489,075; 5,704,505; 4,114,847; 4,989,811; and 5,135,189.

While these devices fulfill their respective, particular objectives and requirements, the aforementioned patents do not disclose a new adjustable bottle holding apparatus. The inventive device includes a flexible elongate tubular member having a first end and a second end; and also includes a clamping member securely attached to the first end of the flexible elongate tubular member with the clamping member having a first clamping portion hingedly attached to a second clamping portion for clamping about an object such as a frame of a crib; and further includes a first arcuate member hingedly attached to a second arcuate member and being lockingly fastened about a bottle with a ring member being fitted about a bottle and with the first and second arcuate members being lockingly fastened about the ring member.

In these respects, the adjustable bottle holding apparatus according to the present invention substantially departs from the conventional concepts and designs of the prior art, and in so doing provides an apparatus primarily developed for the purpose of allowing a parent to perform other activities while a baby is being fed.

SUMMARY OF THE INVENTION

In view of the foregoing disadvantages inherent in the known types of extra hand adjustable bottle holder feeder now present in the prior art, the present invention provides a new adjustable bottle holding apparatus construction wherein the same can be utilized for allowing a parent to perform other activities while a baby is being fed.

The general purpose of the present invention, which will be described subsequently in greater detail, is to provide a new adjustable bottle holding apparatus which has many of the advantages of the extra hand adjustable bottle holder feeder mentioned heretofore and many novel features that result in a new adjustable bottle holding apparatus which is not anticipated, rendered obvious, suggested, or even implied by any of the prior art extra hand adjustable bottle holder feeder, either alone or in any combination thereof.

To attain this, the present invention generally comprises a flexible elongate tubular member having a first end and a second end; and also includes a clamping member securely attached to the first end of the flexible elongate tubular member with the clamping member having a first clamping portion hingedly attached to a second clamping portion for clamping about an object such as a frame of a crib; and further includes a first arcuate member hingedly attached to a second arcuate member and being lockingly fastened about a bottle with a ring member being fitted about a bottle and with the first and second arcuate members being lockingly fastened about the ring member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable bottle holding apparatus which has many of the advantages of the extra hand adjustable bottle holder feeder mentioned heretofore and many novel features that result in a new adjustable bottle holding apparatus which is not anticipated, rendered obvious, suggested, or even implied by any of the prior art extra hand adjustable bottle holder feeder, either alone or in any combination thereof.

It is another object of the present invention to provide a new adjustable bottle holding apparatus which may be easily and efficiently manufactured and marketed.

It is a further object of the present invention to provide a new adjustable bottle holding apparatus which is of a durable and reliable construction.

An even further object of the present invention is to provide a new adjustable bottle holding apparatus which is susceptible of a low cost of manufacture with regard to both materials and labor, and which accordingly is then susceptible of low prices of sale to the consuming public, thereby making such adjustable bottle holding apparatus economically available to the buying public.

Still yet another object of the present invention is to provide a new adjustable bottle holding apparatus which provides in the apparatuses and methods of the prior art some of the advantages thereof, while simultaneously overcoming some of the disadvantages normally associated therewith.

Still another object of the present invention is to provide a new adjustable bottle holding apparatus for allowing a parent to perform other activities while a baby is being fed.

Yet another object of the present invention is to provide a new adjustable bottle holding apparatus which includes a flexible elongate tubular member having a first end and a second end; and also includes a clamping member securely attached to the first end of the flexible elongate tubular member with the clamping member having a first clamping portion hingedly attached to a second clamping portion for clamping about an object such as a frame of a crib; and further includes a first arcuate member hingedly attached to a second arcuate member and being lockingly fastened about a bottle with a ring member being fitted about a bottle and with the first and second arcuate members being lockingly fastened about the ring member.

Still yet another object of the present invention is to provide a new adjustable bottle holding apparatus that eliminates the bottle being dropped by the baby onto a floor.

Even still another object of the present invention is to provide a new adjustable bottle holding apparatus that can be taken anywhere and can be easily and conveniently used as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
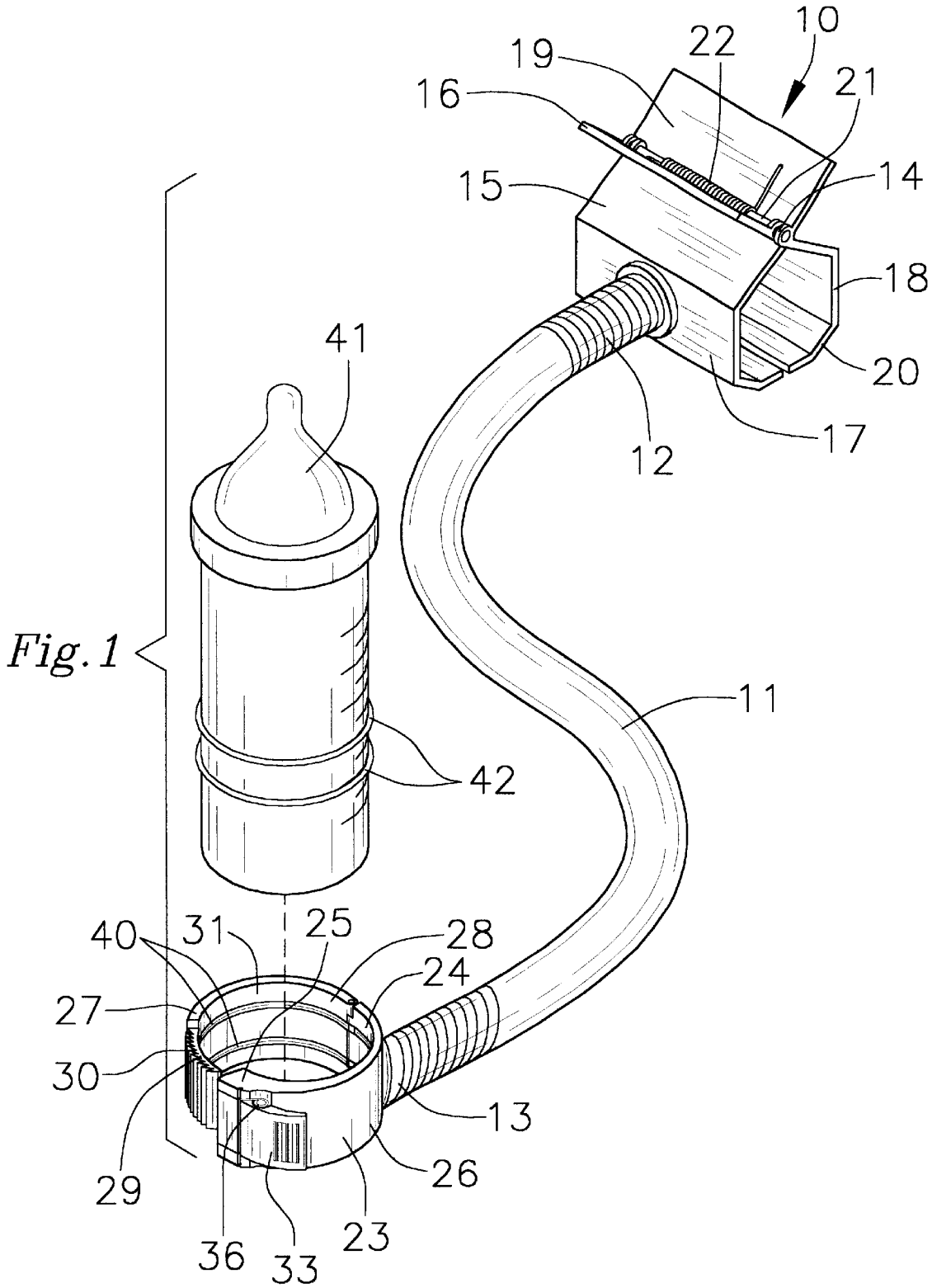
FIG. 1 is a perspective view of a first embodiment of a new adjustable bottle holding apparatus according to the present invention.
Figure 2:
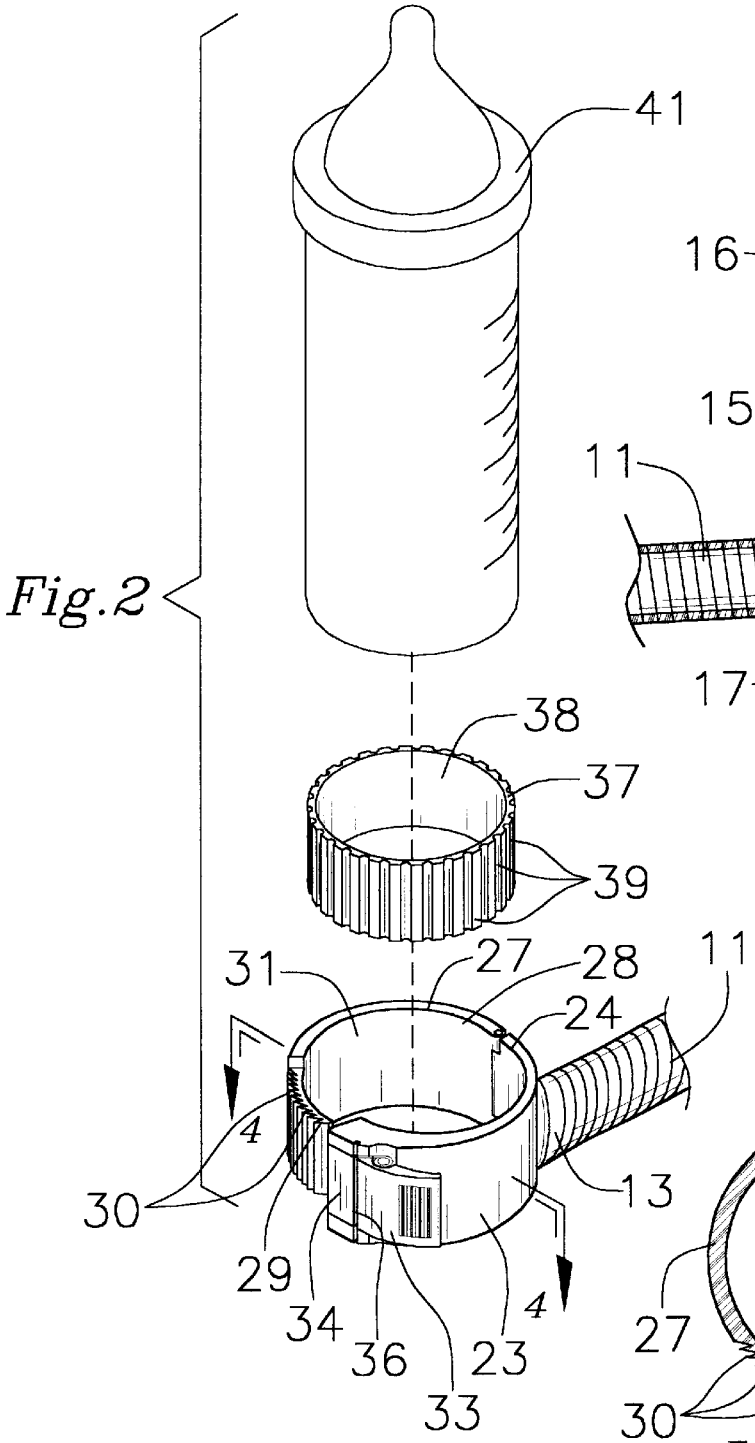
FIG. 2 is an exploded detailed view of a second embodiment of the present invention.
Figure 3:
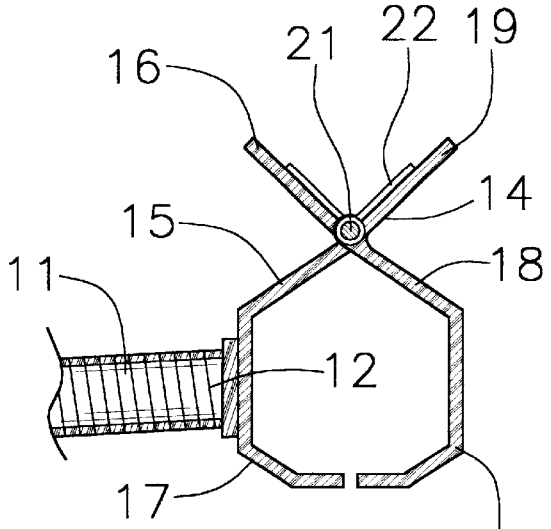
FIG. 3 is a detailed view of the clamping member of the present invention.
Figure 4:
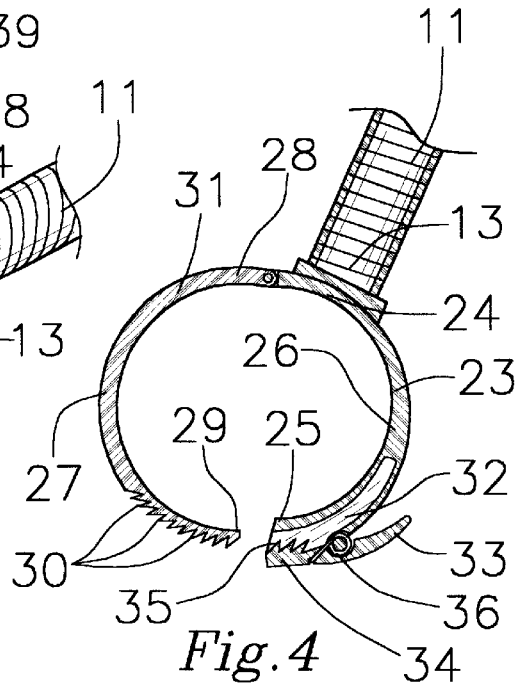
FIG. 4 is a detailed view of means for holding a bottle of the present invention.

With reference now to the drawings, and in particular to FIGS. 1 through 4 thereof, a new adjustable bottle holding apparatus embodying the principles and concepts of the present invention and generally designated by the reference numeral 10 will be described.

As best illustrated in FIGS. 1 through 4, the adjustable bottle holding apparatus 10 generally comprises a flexible elongate tubular member 11 having a first end 12 and a second end 13. A clamping member 14 is securely and conventionally attached or welded to the first end 12 of the flexible elongate tubular member 11 and includes a first clamping portion 15, a second clamping portion 18 hingedly attached to the first clamping portion 15, a hinge member 21 for hingedly attaching the first clamping portion 15 to the second clamping portion 17, and a spring member 22 conventionally mounted about the hinge member 21. The first clamping portion 15 includes a lever portion 16 and a jaw portion 17 having a plurality of sides which are angled relative to one another. The jaw portion 17 also has an end and is securely and conventionally attached to the first end 12 of the flexible elongate tubular member 11. The second clamping portion 18 includes a lever portion 19 and a jaw portion 20 having a plurality of sides which are angled relative to one another with the jaw portion 20 having an end. The second clamping portion 18 and the first clamping portion 15 are hingedly attached to one another intermediate of each others lever portion 16,19 and the jaw portion 17,20. The end of the jaw portion 17 of the first clamping portion 15 and the end of the jaw portion 20 of the second clamping portion 18 are biasedly disposed toward one another and are adapted to clamp about an object. A means for holding a bottle 41 includes a first arcuate member 23 having a first end 24 and a second end 25; a second arcuate member 27 having a first end 29 and a second end 28 which is hingedly attached to the second end 24 of the first arcuate member 23; and a fastening member 33 hingedly attached near the first end 25 of the first arcuate member 23. The first arcuate member 23 is securely and conventionally attached or welded to the second end 13 of the flexible elongate tubular member 11. The first and second arcuate members 23,27 are adapted to enclose and fasten about a bottle 41. The second arcuate member 27 includes a wall 31 and a plurality of teeth 30 disposed upon an exterior of the wall 31 with the teeth 30 extending along a portion of the second arcuate member 27 at the first end 29 thereof. The first arcuate member 23 includes a bore 32 extending therein through the first end 25 thereof, and further includes a wall 26 with the bore 32 being adapted to removeably receive the first end 29 of the second arcuate member 27. The fastening member 33 is hingedly attached at a central portion thereof to an exterior of the wall 26 of the first arcuate member 23 and includes an end portion 34 and a plurality of teeth 35 disposed upon and extending along the end portion 34 on a side of the fastening member 33 facing the first arcuate member 23 and further includes a spring member 36 which biases the end portion 34 toward the first arcuate member 23. The teeth 35 of the fastening member 33 are engageable with the teeth 30 of the second arcuate member 27 for fastening the first and second arcuate members 23,27 together about a bottle 41.

As a first embodiment of the present invention, the first and second arcuate members 23,27 includes a plurality of spaced longitudinal grooves 40 disposed in an interior of the walls 26,31 of and extending a length of the first and second arcuate members 23,27 with the grooves 40 being adapted to receive and retain ribs 42 disposed about a circumference of a bottle 41.

As a second embodiment of the present invention, the means for holding a bottle further includes a ring member 37 having a wall 38 and a plurality of laterally-aligned ridges 39 being securely attached to and spaced along an exterior of the wall 38 for engaging the walls 26,31 of the first and second arcuate members 23,27 with ring member 37 being adapted to fit about a circumference of a bottle 41.

In use, the user clamps the clamp member to a desired object and then either fastens the first and second arcuate members 23,27 about the circumference of a bottle 41. The flexible elongate tubular member 11 allows the user to manipulate and move the bottle 41 as desired. For bottles not having ribs disposed about the circumference thereof, the user can fit the ring member 37 about the bottle 41 and then securely fasten the first and second arcuate members 23,27 about the ring member 37 and the bottle 41. The fastening member 33 secures the first and second arcuate members 23,27 about the bottle 41.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable bottle holding apparatus comprising:

a flexible elongate tubular member having a first end and a second end;

a clamping member securely attached to said first end of said flexible elongate tubular member and including a first clamping portion, a second clamping portion hingedly attached to said first clamping portion, a hinge member for hingedly attaching said first clamping portion to said second clamping portion, and a spring member mounted about said hinge member;

a means for holding a bottle, wherein said means for holding a bottle includes a first arcuate member having a first end and a second end, a second arcuate member having a first end and a second end which is hingedly attached to said second end of said first arcuate member, and a fastening member hingedly attached near said first end of said first arcuate member, said first arcuate member being securely attached to said second end of said flexible elongate tubular member, said first and second arcuate members being adapted to enclose and fasten about a bottle;

wherein said first clamping portion includes a lever portion and a jaw portion having a plurality of sides which are angled relative to one another, said jaw portion also having an end and being securely attached to said first end of said flexible elongate tubular member;

wherein said second clamping portion includes a lever portion and a jaw portion having a plurality of sides which are angled relative to one another, said jaw portion having an end, said second clamping portion and said first clamping portion being hingedly attached to one another intermediate of each others said lever portion and said jaw portion;

wherein said end of said jaw portion of said first clamping portion and said end of said jaw portion of said second clamping portion are biasedly disposed toward one another;

wherein said second arcuate member includes a wall and a plurality of teeth disposed upon an exterior of said wall, said teeth extending along a portion of said second arcuate member at said first end thereof;

wherein said first arcuate member includes a bore extending therein through said first end thereof, and further includes a wall, said bore being adapted to removably receive said first end of said second arcuate member; and wherein said fastening member is hingedly attached at a central portion thereof to an exterior of said wall of said first arcuate member and includes an end portion and a plurality of teeth disposed upon and extending along said end portion on a side of said fastening member facing said first arcuate member and further includes a spring member biasing said end portion toward said first arcuate member, said teeth of said fastening member being engageable with said teeth of said second arcuate member for fastening said first and second arcuate members together about a bottle.

2. An adjustable bottle holding apparatus as described in claim 1, wherein said first and second arcuate members includes a plurality of spaced longitudinal grooves disposed in an interior of said walls of and extending a length of said first and second arcuate members, said grooves being adapted to receive and retain ribs disposed about a circumference of the bottle.

3. An adjustable bottle holding apparatus as described in claim 1, wherein said means for holding the bottle further includes a ring member having a wall and a plurality of laterally-aligned ridges being securely attached to and spaced along an exterior of said wall for engaging said walls of said first and second arcuate members.

4. An adjustable bottle holding apparatus comprising:

a flexible elongate tubular member having a first end and a second end;

a clamping member securely attached to said first end of said flexible elongate tubular member and including a first clamping portion, a second clamping portion hingedly attached to said first clamping portion, a hinge member for hingedly attaching said first clamping portion to said second clamping portion, and a spring member mounted about said hinge member said first clamping portion including a lever portion and a jaw portion having a plurality of sides which are angled relative to one another, said jaw portion also having an end and being securely attached to said first end of said flexible elongate tubular member, said second clamping portion including a lever portion and a jaw portion having a plurality of sides which are angled relative to one another, said jaw portion having an end, said second clamping portion and said first clamping portion being hingedly attached to one another intermediate of each others said lever portion and said jaw portion, said end of said jaw portion of said first clamping portion and said end of said jaw portion of said second clamping portion being biasedly disposed toward one another and being adapted to clamp about an object; and a means for holding a bottle including a first arcuate member having a first end and a second end, a second arcuate member having a first end and a second end which is hingedly attached to said second end of said first arcuate member, and a fastening member hingedly attached near said first end of said first arcuate member, said first arcuate member being securely attached to said second end of said flexible elongate tubular member, said first and second arcuate members being adapted to enclose and fasten about a bottle, said second arcuate member including a wall and a plurality of teeth disposed upon an exterior of said wall, said teeth extending along a portion of said second arcuate member at said first end thereof, said first arcuate member including a bore extending therein through said first end thereof, and further including a wall, said bore being adapted to removeably receive said first end of said second arcuate member, said fastening member being hingedly attached at a central portion thereof to an exterior of said wall of said first arcuate member and including an end portion and a plurality of teeth disposed upon and extending along said end portion on a side of said fastening member facing said first arcuate member and further including a spring member biasing said end portion toward said first arcuate member, said teeth of said fastening member being engageable with said teeth of said second arcuate member for fastening said first and second arcuate members together about the bottle.

5. An adjustable bottle holding apparatus as described in claim 4, wherein said first and second arcuate members includes a plurality of spaced longitudinal grooves disposed in an interior of said walls of and extending a length of said first and second arcuate members, said grooves being adapted to receive and retain ribs disposed about a circumference of the bottle.

6. An adjustable bottle holding apparatus as described in claim 4, wherein said means for holding the bottle further includes a ring member having a wall and a plurality of laterally-aligned ridges being securely attached to and spaced along an exterior of said wall for engaging said walls of said first and second arcuate members.

7. An adjustable bottle holding apparatus comprising:

a flexible elongate tubular member having a first end and a second end;

a clamping member securely attached to said first end of said flexible elongate tubular member and including a first clamping portion, a second clamping portion hingedly attached to said first clamping portion, a hinge member for hingedly attaching said first clamping portion to said second clamping portion, and a spring member mounted about said hinge member;

a means for holding a bottle;

wherein said means for holding a bottle includes a first arcuate member having a first end and a second end, a second arcuate member having a first end and a second end which is hingedly attached to said second end of said first arcuate member, and a fastening member hingedly attached near said first end of said first arcuate member, said first arcuate member being securely attached to said second end of said flexible elongate tubular member, said first and second arcuate members being adapted to enclose and fasten about a bottle; and wherein said fastening member is hingedly attached at a central portion thereof to an exterior of said wall of said first arcuate member and includes an end portion and a plurality of teeth disposed upon and extending along said end portion on a side of said fastening member facing said first arcuate member and further includes a spring member biasing said end portion toward said first arcuate member, said teeth of said fastening member being engageable with said teeth of said second arcuate member for fastening said first and second arcuate members together about a bottle.

8. An adjustable bottle holding apparatus as described in claim 7, wherein said first clamping portion includes a lever portion and a jaw portion having a plurality of sides which are angled relative to one another, said jaw portion also having an end and being securely attached to said first end of said flexible elongate tubular member.

9. An adjustable bottle holding apparatus as described in claim 8, wherein said second clamping portion includes a lever portion and a jaw portion having a plurality of sides which are angled relative to one another, said jaw portion having an end, said second clamping portion and said first clamping portion being hingedly attached to one another intermediate of each others said lever portion and said jaw portion.

10. An adjustable bottle holding apparatus as described in claim 9, wherein said end of said jaw portion of said first clamping portion and said end of said jaw portion of said second clamping portion are biasedly disposed toward one another.

11. An adjustable bottle holding apparatus as described in claim 7, wherein said second arcuate member includes a wall and a plurality of teeth disposed upon an exterior of said wall, said teeth extending along a portion of said second arcuate member at said first end thereof.

12. An adjustable bottle holding apparatus as described in claim 7, wherein said first arcuate member includes a bore extending therein through said first end thereof, and further includes a wall, said bore being adapted to removably receive said first end of said second arcuate member.

13. An adjustable bottle holding apparatus as described in claim 7, wherein said first and second arcuate members includes a plurality of spaced longitudinal grooves disposed in an interior of said walls of and extending a length of said first and second arcuate members, said grooves being adapted to receive and retain ribs disposed about a circumference of the bottle.

14. An adjustable bottle holding apparatus as described in claim 7, wherein said means for holding the bottle further includes a ring member having a wall and a plurality of laterally-aligned ridges being securely attached to and spaced along an exterior of said wall for engaging said walls of said first and second arcuate members.

* * * * *